United States Patent [19]

Kasai

[11] 4,289,549

[45] Sep. 15, 1981

[54] RESIN BONDED PERMANENT MAGNET COMPOSITION

[75] Inventor: Kazutomo Kasai, Suwa, Japan

[73] Assignee: Kabushiki Kaisha Suwa Seikosha, Tokyo, Japan

[21] Appl. No.: 87,602

[22] Filed: Oct. 23, 1979

[30] Foreign Application Priority Data

Oct. 31, 1978 [JP] Japan ..... 53/134323
Jul. 24, 1979 [JP] Japan ..... 54/94001

[51] Int. Cl.[3] ..... G03G 9/14; H01F 1/00; H01F 1/117

[52] U.S. Cl. ..... 148/101; 75/252; 148/31.57; 252/62.54

[58] Field of Search ..... 148/31.57, 101; 252/62.54; 75/252

[56] References Cited

U.S. PATENT DOCUMENTS

| | | | |
|---|---|---|---|
| 3,982,971 | 9/1976 | Yamanaka et al. | 148/31.57 |
| 4,000,982 | 1/1977 | Ueda | 29/182.3 |
| 4,022,701 | 5/1977 | Sawa et al. | 252/62.54 |
| 4,081,297 | 3/1978 | Nagel et al. | 148/103 |
| 4,099,995 | 7/1978 | Menth et al. | 148/101 |
| 4,111,823 | 9/1978 | Kobayashi et al. | 252/62.54 |
| 4,121,952 | 10/1978 | Senn et al. | 148/31.57 |
| 4,131,495 | 12/1978 | Menth et al. | 148/31.57 |
| 4,135,953 | 1/1979 | Nagel et al. | 148/103 |
| 4,192,696 | 3/1980 | Menth et al. | 148/101 |
| 4,200,547 | 4/1980 | Beck | 252/62.54 |

OTHER PUBLICATIONS

Tawara et al., IEEE Trans. Magnetics, *Mag. 12,* (Nov. 1976), 954.

Senno et al., IEEE Trans. Magnetics, *Mag. 10,* (1974) 313.

Tawara et al., Japan J. Appl. Phys. 12 (1973) 761.

Menth et al., Appl. Phys. Letts. 29 (1976) 270.

*Primary Examiner*—Upendra Roy

*Attorney, Agent, or Firm*—Blum, Kaplan, Friedman, Silberman & Beran

[57] ABSTRACT

An improved magnetic material for a permanent magnet including at least 90 volume percent of a single phase of a samarium-transition metal alloy in a 2–17 molar ratio is provided. The alloy may be represented by the formula $Sm_2(Co\ Cu\ Fe\ M)_{17}$ wherein M is at least one element selected from the group of manganese, silcon, titanium, niobium, zirconium, hafnium, tantalum, chromium, vanadium, molybdenum and aluminum.

9 Claims, No Drawings

RESIN BONDED PERMANENT MAGNET COMPOSITION

BACKGROUND OF THE INVENTION

This invention relates generally to an improved material for a permanent magnet, and more particularly a composition of samarium-transition metal forming a single phase in the molar ratio of about 2 to 17.

The rare-earth metals and cobalt form various intermetallic compounds such as $RCo_{13}$, $R_2Co_{17}$, $RCo_5$, $R_5Co_{19}$, $R_2Co_9$, $RCo_3$, $RCo_2$, $R_2Co_3$, $R_4Co_3$, $R_{24}Co_{17}$, $R_9Co_4$ and $R_3Co$. $RCo_5$ and $R_2Co_{17}$ have been used as a material for permanent magnet. Specifically, the $RCo_5$ type magnets are used for industrial purposes and the demand for these magnets is increasing with time. A samarium alloy, $SmCo_5$ is an example of the $RCo_5$-type magnet which provides a greater energy product than the conventional alnico, ferrite and plutonium-cobalt magnets. Generally speaking, $R_2Co_{17}$ has a higher saturation magnetization (Ms) than the $RCo_5$ alloy so that one would expect the $R_2Co_{17}$ to be a suitable material for a magnet. However, the $R_2Co_{17}$ has a lower coercive force (Hc). Therefore, it was once considered that there was no prospect of putting this latter material into practical use. It has since been learned that the coersive force may be increased by adding an appropriate amount of copper, thus drawing renewed attention to this material.

$R_2Co_{17}$ and $R_2Fe_{17}$ form a psedobinary system which may be represented by the formula: $R_2(Co_{1-x}Fe_x)_{17}$. The saturation magnetization (Ms) increases corresponding to an increase in the value of x to the extent of about 0.6 when the uniaxial anisotropy is maintained. The anisotropic magnetic field (Ha), which is considered as the upper limit of the coercive force is 65 KOe when x equals 0, decreases when x equals 0.2 and is about 20 KOe when x equals 0.5. However, it has been found that when the iron is added to the $Sm_2(Co\ Cu)_{17}$ in amounts even less than 10 weight percent, the iron causes considerable deterioration of the coercive force. Thus, the advantage that the saturation magnetization is increased due to the presence of iron, has not been efficiently used.

In contrast, when copper is added to the alloy the saturation magnetization (Ms) is decreased considerably, even when the coercive force is increased. It has been found that when cobalt in the $Sm_2(Co\ Cu)_{17}$ is replaced by copper, the saturation magnetization decreases 12% with a 8 weight percent replacement of copper and Ms decreases 25% with a 16 weight percent replacement by copper. The decrease in coercive force caused by the replacement with iron and the decrease of the saturation magnetization caused by the replacement of copper may be improved by a small addition of the other element. If the copper replacement is maintained below 8 weight percent and the iron replacement is above 15 weight percent, then intrinsic coercive force (iHc) of about 6 or more KOe may be obtained.

In a magnetic material for a permanent magnet including zirconium, the ratio of the samarium to the transition metal (hereinafter referred to as "the TM ratio") is no longer 2 to 17, but is approximately 1 to 7. In the range near the TM ratio of 1 to 7, metal of the 1-5 phase having the TM ratio of 1 to 5, and metal of the 2-17 phase having the TM ratio of 2 to 17 coexist.

In an evaluation between the $SmCo_5$, which forms the fundamental 1-5 phase, and the $Sm_2Co_{17}$ which forms the fundamental 2-17 phase, the Ms of the $SmCo_5$ is as low as 10.0 Kg. When iron replaces the cobalt in the $Sm_2Co_{17}$, saturation magnetization is increased. In contrast, in the $SmCo_5$ material, it has been found that Ms is barely effected by the replacement with iron. Additionally, the following facts have been determined from X-ray analysis. Namely, that the solid solubility of copper and the 1-5 phase is greater than that in the 2-17 phase. Specifically, more copper dissolves into the 1-5 phase in the range wherein the two phases coexist. Thus, in the range where the TM ratio of 1 to 7 the 1-5 phase having low saturation magnetization exists in large amounts. In addition to the fact that the 1-5 phase has a large capacity for copper which reduces the Ms, zirconium present in the 1-5 phase traps the iron and forms a new composition. Therefore, it has been difficult to obtain a high performance magnetic material. Accordingly, it would be desirable to provide a high performance permanent magnet overcoming the shortcomings encountered with the prior art compositions.

SUMMARY OF THE INVENTION

Generally speaking, in accordance with the invention, an improved magnetic material for a high performance permanent magnet is provided. The magnetic composition includes at least 90 volume percent of a single phase samarium-transition metal alloy in a molar ratio of about 2 to 17. The magnetic material may be represented by the formula $Sm_2(Co\ Cu\ Fe\ M)_{17}$, wherein M is at least one element selected from the group of manganese, silicon, titanium, niobium, zirconium, hafnium, tantalum, chromium, vanadium, molybdenum and aluminum. In a first preferred embodiment of the invention, a composition may be represented by the following weight percentages:

$22.0 \leqq Sm \leqq 24.0$;
$2.5 \leqq Cu \leqq 10.0$;
$5.0 \leqq Fe \leqq 18.0$;
$0.3 \leqq M \leqq 4.0$, with the remainder being cobalt. In a second preferred embodiment of the invention, the composition may be represented by the following weight percentages:

$22.0 \leqq Sm < 24.0$;
$2.5 \leqq Cu \leqq 13.0$;
$18.0 < Fe \leqq 39.0$;
$0.3 \leqq M \leqq 4.0$, with the remainder being cobalt.

The material for a permanent magnet may be combined with at least 10 percent by volume of a combining agent for preparing a molded ingot. Up to about 50% by volume of such a combining agent, such as a thermoplastic resin may be used and the solidified magnet may be formed by compression molding, injection molding or impregnation molding.

Accordingly, it is an object of the invention to provide an improved material for a high performance permanent magnet.

Another object of the invention is to provide a material for an improved high performance permanent magnet having increased saturation magnetization and a high magnetic energy.

A further object of the invention is to provide an improved samarium-transition metal alloy for a high performance permanent magnet.

Still another object of the invention is to provide an improved samarium-transition metal alloy for a high performance permanent magnet which is readily moldable upon addition of a combining agent.

Still a further object of the invention is to provide an improved material of a samarium-transition metal alloy comprising at least 90 volume percent of the single 2–17 phase.

Another object of the invention is to provide an improved process for preparing a high performance samarium-transition metal permanent magnet material.

A further object of the invention is to provide an improved ingot of a samarium-transition metal alloy for an improved high performance permanent magnet.

Still other objects and advantages of the invention will in part be obvious and will in part be apparent from the specification.

The invention accordingly comprises the several steps and the relation of one or more of such steps with respect to each of the others, and the composition and article possessing the features, properties, the article which possesses the characteristics, properties and relation of elements, and the relation of constituents, which are exemplified in the following detailed disclosure, and the scope of the invention will be indicated in the claims.

DESCRIPTION OF THE PREFERRED EMBODIMENTS

The composition of the materials for a permanent magnet have an improved high performance properties, such as an intrinsic coercive force (iHc) of at least about 5.0 KOe and a saturation magnetization (Ms) of at least 12.0 Kg obtained in accordance with the invention as follows. The preferred compositions are compounded and heat treated in order to obtain a material including at least 90 volume percent of the 2–17 phase.

In order to obtain a material wherein the 2–17 phase occupies at least 90 volume percent, the samarium must be present in amounts less than about 24.0 weight percent. When samarium is present in amounts of about 24.0 weight percent and more, the 1–5 phase exists and the saturation magnetization is lowered to a value less than about 12.0 Kg. In this case, the 2–17 phase cannot occupy at least 90 volume percent of the material.

The lower value for the samarium content is about 22.0 weight percent in the preferred compositions in accordance with the invention. When the samarium content decreases to less than about 22.0 weight percent the Fe-Co phase, which causes a deterioation in coercive force, coexists with the 2–17 phase. Thus, a material having intrinsic coercive force of at least about 5.0 KOe cannot be obtained. When the quantity of copper is less than about 2.5 weight percent, the intrinsic coercive force is at most about 5.0 KOe. Additionally, copper must be present in amounts less than about 10.0 weight percent in order to retain the saturation magnetization of at least about 12.0 Kg for material of low Fe content. It has also been found that when iron is present in amounts greater than about 5.0 weight percent the saturation magnetization value tends to increase. However, there is a considerable decrease in the value of the intrinsic coercive force if more than about 18.0 weight percent of the iron is present. Therefore, iron is included in the compositions in amounts between about 5.0 and 18.0 weight percent.

In addition to the samarium, copper and iron in the ranges specified, at least one element selected from the group of manganese, silicon, titanium, niobium, hafnium, chromium, vanadium, molybdenum, aluminum, zirconium, and mixtures thereof may be added alone or in combination. This addition of the M element improves the value of the intrinsic coercive force (iHc). The effect obtained is not always an equal increase depending on the material or materials added, but the M elements tend to increase the intrinsic coercive force. This addition seems to promote and induce the copper-rich phase into the simple 2–17 phase when the alloy is heat treated and tends to control the dispersion in order to promote the pinning effect on the domain walls. These elements tend to effect the intrinsic coercive force when included in the alloys in amounts equal to or greater than 0.3 weight percent. However, increase in the amount of the M elements tends to deteriorate the saturation magnetization. Considering the overall desired results, the M elements are added in accordance with the invention, preferably in amounts between about 0.3 and 4.0 weight percent.

It has also been found in accordance with the invention, that a marked increase in the saturation magnetization value occurs when iron is present in amounts greater than 18.0 weight percent when the samarium content is maintained between about 22.0 and less than 24.0 weight percent. This increase has been found to exist when copper is included between about 2.5 weight percent and 13.0 weight percent. If the copper is less than 2.5 weight percent, the coercive force obtained is at most 5.0 KOe. As noted above, in order to obtain a saturation magnetization value of at least about 12.0 Kg in this embodiment, the copper must not be present in amounts above 13.0 weight percent.

This increase in magnetization saturation value which occurs when the iron is present in amounts above about 18.0 weight percent tends to decrease the intrinsic coercive force. This decrease in intrinsic coercive force may be overcome by selecting proper heat treatment conditions in accordance with the process for making the composition in accordance with the invention as will be described in more detail in connection with the examples. This overall improvement in magnetic characteristic is obtained for an increased iron content to the extent of about 39.0 weight percent. In these compositions in accordance with the invention, the amount of the transition metal is present in amounts between about 0.3 and 4.0 weight percent.

In each of the composition ranges noted above, the elements may be added independently or in combination. The particular ratio of elements added independently or in combination is not particularly critical.

An ingot of material for a permanent magnet formed in accordance with the invention includes at least 90 volume percent of the single 2–17 phase. Experimentation has provided results that the ingot formed of the single phase is in the TM ratio of about 1 to 8.1 through 1 to 8.3. The 2–17 phase material has a high intrinsic coercive force even if the quantity of the copper component is less than the amount included in the 1–7 alloy. This fact has been verified by permanent magnets made from an ingot of the simple 2–17 phase. Additionally, an ingot of the 2–17 phase, including 5.6 weight percent copper has an intrinsic coercive force higher than 6 KOe. Originally the 2–17 phase had high saturation magnetization which permitted inclusion of small amounts of copper. Accordingly, an alloy of high saturation magnetization is realized by the single 2–17 phase. The value of saturation magnetization of a sintered magent of the 1–7 phase is at most 11 Kg but the value is as high as 12 Kg for the 2–17 alloy.

In order to satisfy the objectives of the invention, namely obtaining a magnetic composition for a permanent magnet having high saturation magnetization and high magnetic energy, the 2–17 phase must be present at least about 90% by volume of the composition. Accordingly, it is necessary that a magnet of this type be made differently than a conventional permanent magnets including the 1–5 phase coexisting with the 2–17 phase. In accordance with the invention, the results obtained in accordance with the objectives have resulted from a further development over Japanese Patent Application No. 79332/78 and No. 80746/77. In these prior Japanese applications, only the addition of zirconium was disclosed in a samarium-copper-cobalt type alloy and was added independently. Therefore, the description of the experimental data relating to the sole addition of zirconium is deleted and the embodiments in accordance with this invention are noted more fully in the following examples.

The compositions for permanent magnet materials in accordance with the invention will be described in detail in the following examples. These examples are intended to be illustrative and are not presented in a limiting sense. All percentages specified are weight percents, based on the total weight of the composition, unless otherwise indicated.

EXAMPLE 1

Alloys of 23.3% samarium, 4.9% copper, 15.0% iron, 2% of an M element as shown in Table 1, and the remainder cobalt were prepared as follows. The material in the specified composition is melted and fine ground into a powder having a particle size of between about 2 and 30 microns in an inert atmosphere in order to prevent oxidization. The ground compositions were shaped in a magnetic field, sintered at 1200° C., solution-treated at 1180° C. then aged for about 2 hours at 850° C.

Table 1 lists the measured results of the magnetic properties of these permanent magnets. When the metallurgical structure of each of the sintered magnets was observed by X-ray analysis, each was found to include at least 95% of the 2–17 phase. Other phases, such as the Fe-Co rich phase and the oxidizing phase were also present.

TABLE 1

| M element (molar ratio) | Property | | | |
|---|---|---|---|---|
| | Saturation Magnetization-Ms (KG) | Residual Magnetization-Br (KG) | Intrinsic Coercive Force-iHc (KOe) | Energy Product-Bx Hmax (MGOe) |
| none | 12.9 | 10.0 | 4.7 | 15.9 |
| Ti | 12.7 | 10.8 | 6.8 | 26.3 |
| Si | 12.7 | 10.3 | 6.0 | 21.1 |
| Zr + Cr (1:1) | 12.5 | 11.0 | 7.2 | 27.9 |
| Ti + Mo (1:2) | 12.7 | 10.8 | 6.6 | 26.6 |

Table 1 reports the measured magnetic properties for magnets prepared in accordance with the invention including titanium, silicon, zirconium and chromium and titanium and molybdenum. It is to be understood that other M elements noted above will impart the same improvements to the residual magnetization, intrinsic coercive force and energy product.

EXAMPLE 2

Alloys of 23.5% samarium, 7.5% copper, 9.0% iron and the remainder cobalt and including titanium in varying weight percentages from 0.5 to 3.5% as shown in Table 2 were prepared. These alloys were prepared in accordance with the process for manufacturing the magnet as described in detail in Example 1. The measured magnetic properties of the magnets of varying titanium composition are illustrated in the following Table 2.

TABLE 2

| Quantity of Addition Ti | Property | | | |
|---|---|---|---|---|
| | Ms (KG) | Br (Kg) | iHc (KOe) | B × Hmax (KGOe) |
| 0 | 12.7 | 10.1 | 5.0 | 18.3 |
| 0.5 | 12.7 | 10.5 | 5.7 | 20.7 |
| 1.5 | 12.5 | 10.8 | 6.7 | 27.2 |
| 2.5 | 12.4 | 10.8 | 6.8 | 25.8 |
| 3.5 | 12.0 | 10.1 | 8.2 | 20.3 |

EXAMPLE 3

Alloys of 23.0% samarium, 8.0% copper, 21.0% iron, 2.5% of an M element as shown in Table 3, and the remainder cobalt were prepared as follows. The material in the specified compositions was melted and finely ground into a powder having a particle size of between about 2 to 50 microns in an inert atmosphere in order to prevent oxidation. The ground materials were shaped in a magnetic field, sintered at 1220° C., solution-treated at 1140° C. and then aged for 14 hours at 820° C.

Table 3 lists the measured results of the magnetic properties of these permanent magnets. When the metallurgical structure of each of the sintered magnets was observed by X-ray analysis, each was found to include at least 95% of the 2–17 phase. Other phases, such as the Fe-Co rich phase and the oxidizing phase were also present.

TABLE 3

| M element (molar ratio) | Property | | | |
|---|---|---|---|---|
| | Ms (KG) | Br (KG) | iHc (KOe) | B × Hmax (MGOe) |
| none | 13.5 | 7.5 | 3.2 | 11.5 |
| Ti | 13.2 | 10.8 | 5.9 | 24.0 |
| Nb + Mn (1:1) | 13.5 | 10.8 | 6.1 | 24.3 |
| Zr + Si (1:1) | 13.1 | 11.6 | 6.8 | 30.2 |
| Ti + Nb (2:1) | 12.9 | 10.9 | 6.5 | 27.2 |

Table 3 reports the measured magnetic properties for magnets prepared in accordance with the invention including titantium; Nb and Mn; Zr and Si; and titanium and niobium. It is to be understood that other M elements noted above will impart the same improvements to the residual magnetization, intrinsic coercive force and energy product.

EXAMPLE 4

Alloys of 23.0% samarium, 8.0% copper, 21.0% iron and the remainder cobalt together with titantium in varying amounts between 0.5 and 3.5 weight percent were prepared. The magnetic properties of a permanent magnet formed in accordance with the procedures of Example 3 are shown in Table 4.

TABLE 4

| Quantity of Addition Ti | Property | | | |
|---|---|---|---|---|
| | Ms (KG) | Br (KG) | iHc (KOe) | B × Hmax (MGOe) |
| 0 | 13.5 | 7.5 | 3.2 | 11.5 |
| 0.5 | 13.3 | 10.7 | 5.7 | 22.5 |
| 1.0 | 13.2 | 10.8 | 5.9 | 24.1 |
| 2.5 | 13.2 | 10.8 | 5.9 | 24.0 |
| 3.5 | 12.9 | 10.7 | 7.4 | 25.5 |
| 4.5 | 12.5 | 10.5 | 7.0 | 25.0 |

EXAMPLE 5

An ingot prepared in accordance with the procedures of Example 1 and including 1.5 weight percent titanium was mixed, heat-treated and ground into a fine powder between about 3 to 50 microns. A volume of about 20% liquid epoxy resin was mixed with the fine powder which was then pressed and formed in a magnetic field. The magnet was heated in order to stiffen the resin. The measured magnetic properties of the magnet were as follows:

| Characteristic | Value |
|---|---|
| Ms | 8.2 KG |
| Br | 7.6 KG |
| iHc | 6.7 KOe |
| bHc | 6.0 KOe |
| B × Hmax | 14.1 MGOe |

EXAMPLE 6

An ingot prepared in accordance with the procedures of Example 4 and including 2.5 weight percent titantium was mixed, heat-treated and ground into a fine powder between about 3 to microns. A column of about 17% liquid epoxy resin was admixed with the fine powder which was then pressed and formed in a magnetic field. The magnet was heated in order to stiffen the resin. The measured magnetic properties of the magnet were as follows:

| Characteristic | Value |
|---|---|
| Ms | 8.8 KG |
| Br | 8.1 KG |
| iHc | 5.9 KOe |
| bHc | 5.5 KOe |
| B × Hmax | 15.2 MGOe |

Examples 5 and 6 illustrate preparation of an ingot in accordance with the invention wherein the compression molding utilizing a heat stiffening resin is included. A thermoplastic resin may also be used as a combining agent. Additionally, the magnetic ingot thus formed may be formed by injection molding and impregnation molding as well as the compression molding described.

The amount of the combining agent added to the magnetic composition should be small so that there is minimal interference with the magnetic characteristics. However, the amount must be great enough to impart moldability and provide a strong molded form of magnet. It has been found that when the amount of the combining agent is about 10% in volume or less, the product is not sufficiently strong. On the other hand, when the amount of the combining agent exceeds 50% by volume, the magnetic characteristics of the magnet are decreased significantly. Therefore, the ingot prepared in accordance with the invention includes between about 10 and 50 volume percent of the combining agent based on the total volume should be mixed.

Accordingly, the materials for permanent magnets in accordance with the invention provide a permanent magnet having a high energy product. These magnets are widely applicable for industrial uses such as motors suitable for use in electronic wristwatches, small speakers, miniaturized motors and the like. The material for a permanent magnet in accordance with the invention is based on the single $R_2Co_{17}$ phase. Accordingly, the invention may be employed not only to samarium as disclosed herein, but also to other rare-earth elements such as yttrium, praseodymium, cesium, and the like. In addition, a portion of the samarium may be replaced by these other rare-earth elements. Including the transition metal M elements into the alloy makes grinding the alloy easier and tends to improve the fluidity of the melted alloy at the time of casting.

It will thus be seen that the objects set forth above, among those made apparent from the preceding description, are efficiently attained and, since certain changes may be made in carrying out the above process and in the composition set forth without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A resin-bonded permanent magnet composition comprising a permanent magnet composition of a single phase rare-earth $R_2(Co\ Cu\ Fe\ M)_{17}$ alloy, wherein: the rare earth element is present in the alloy in an amount about equal to or greater than 22.0 and less than 24.0 weight percent; copper is present in the alloy in an amount about equal to or greater than 2.5 and equal to or less than 13.0 weight percent, iron is present in an amount at least 15.0 and less than or equal to 39.0 weight percent; M is at least one element selected from the group consisting of manganese, silcon, titanium, niobium, zirconium, hafnium, tantalum, chromium, vanadium, molybdemium and aluminum and is present in the alloy in an amount about equal to or greater than 0.3 and less than or equal to 4.0 weight percent; the balance of the alloy being cobalt and including at least about 10 volume percent of a combining agent admixed with said composition, based on the total volume of the composition and combining agent.

2. The composition of claim 1, wherein the rare-earth metal is samarium.

3. The composition of claim 1, wherein said combining agent is present between about 10 and 50 volume percent.

4. The composition of claim 3, wherein said combining agent is an epoxy resin.

5. The composition of claim 3, wherein said combining agent is a thermoplastic resin.

6. A resin-bonded permanent magnet ingot comprising a permanent magnet composition of a single phase $Sm_2(Co\ Cu\ Fe\ M)_{17}$ alloy, wherein the samarium is present in the alloy in an amount about equal to or greater than 22.0 and less than 24.0 weight percent; copper is present in the alloy in an amount about equal to or greater than 2.5% and equal to or less than 13.0 weight percent; iron is present in an amount greater than 18.0 and less than or equal to 39.0 weight percent; and M is at least one element selected from the group consisting of manganese, silicon, titanium, niobium, zirconium, hafnium, tantalum, chromium, vanadium, molybdemium and aluminum and is present in the alloy in an amount about equal to or greater than 0.3 and less than or equal to 4.0 weight percent, the balance of the alloy being cobalt, said permanent magnet composition compressed with at least 10% by volume of a combining agent, based on the volume of the composition and combining agent.

7. The ingot of claim 6, wherein said combining agent is present between about 10 and 50 volume percent based on the total volume of the composition and combining agent.

8. The ingot of claim 6, wherein said combining agent is an epoxy resin.

9. The ingot of claim 7, wherein said combining agent is a thermoplastic resin.

* * * * *